US005417339A

United States Patent [19]

Liu

[11] Patent Number: 5,417,339

[45] Date of Patent: May 23, 1995

[54] PARTS CONTAINER

[76] Inventor: Lydia Shui-Lu Liu, Room 1, 6th Fl., No. 11, Sec. 4, Nanking E. Rd., Taipei, Taiwan, Prov. of China

[21] Appl. No.: 238,705

[22] Filed: May 5, 1994

[51] Int. Cl.[6] ..... B65D 43/16

[52] U.S. Cl. ..... 220/315; 206/338; 206/45.23; 220/306; 220/326; 220/338; 220/339; 220/665; 220/771

[58] Field of Search ..... 206/338, 372, 541, 549, 206/45.23; 220/306, 315, 324, 326, 334, 337, 338, 339, 602, 662, 665, 771

[56] References Cited

U.S. PATENT DOCUMENTS

| | | | |
|---|---|---|---|
| 2,903,127 | 9/1959 | Dorman | 206/338 |
| 3,327,887 | 6/1967 | Chalmers | 220/339 |
| 4,366,915 | 1/1983 | Seidler | 220/306 |
| 4,471,881 | 9/1984 | Foster | 220/339 |
| 4,779,756 | 10/1988 | Buelens et al. | 220/339 |
| 5,139,165 | 8/1992 | Hara | 220/339 |
| 5,356,025 | 10/1994 | Renault | 220/338 |

*Primary Examiner*—Jimmy G. Foster
*Attorney, Agent, or Firm*—Hedman, Gibson & Costican

[57] ABSTRACT

A parts container includes a transparent box having a bottom, a first enclosure extending upward from the bottom having a front wall, a rear wall and two side walls connected therebetween, a second enclosure extending upward from a top portion of the first enclosure having a relatively high wall, a relatively low wall, and two side walls connected therebetween, thus defining a slant opening at a top thereof, a shoulder being defined between the first enclosure and the second enclosure, a vertical track being formed from a top periphery of the relatively high wall of the second enclosure down to substantially a middle position of the rear wall of the first enclosure. A cover is adapted to cover the second enclosure of the box having a lower periphery thereof abut against the shoulder. The cover has a flexible strip which extends downwardly from a wall of the cover and is received in the vertical track of the transparent box.

8 Claims, 6 Drawing Sheets

PARTS CONTAINER

FIELD OF THE INVENTION

The present invention relates to a parts container particularly one which is easily operated to access parts therein.

BACKGROUND OF THE INVENTION

Parts containers are popular in the manufacturing field because manufacturing technicians require many parts containers to store small items such as screws, nuts, etc. Most of the containers include a housing structure and a cover which is apt to drop off due to frequent accessing of the small items in the housing structure. To prevent the cover from dropping off, the user has to hold the cover temporarily with his/her hand or put the cover in his/her pocket thus affecting his/her working efficiency. It is requisite to provide a parts container which does not require the user to make extra effort to place the cover when the user accesses the items in the container.

SUMMARY OF THE INVENTION

It is an object of the present invention to provide a parts container allowing accessing of parts in and out with a safe and easy manner.

It is one aspect of the present invention to provide a parts container comprising a transparent box having a first enclosure which has a front wall, a rear wall and two side walls connected therebetween and a base, a second enclosure extending from a top portion of the first enclosure having a relatively high wall, a relatively low wall, and two side walls connected therebetween, thus defining a slant opening at a top thereof, a shoulder being formed between the first enclosure and the second enclosure, a track being formed from a top periphery of the relatively high wall of the second enclosure to substantially a middle position of the rear wall of the first enclosure. A cover is adapted to cover the second enclosure of the box having a lower periphery thereof abutting against the shoulder including a flexible strip which extends downwardly from a wall of the cover and is received in the vertical track of the transparent box. A groove is defined on the flexible strip substantially perpendicular to a longitudinal axis of the strip. Normally, the cover is closed when the flexible strip is inserted in the track of the transparent box. The groove functions as a precisely located hinging point upon opening of the cover. When the cover is opened from the transparent box, a rear bottom edge of the cover to the left and right of the strip presses against the relatively high wall of the second enclosure of the transparent box bending the groove at the strip until when pivoted fully open, it remains in a fully open position, resisting closing. Therefore, the cover is captive to the transparent box and opened fully so as to not obstruct decanting parts from the container.

Also, the box with its fully-opened cover now can be placed on a flat surface and is supported in an easel-fashion thus preventing parts from falling out of the container. In closing the cover after use, when a front bottom edge of the cover reaches the longitudinal center line of the transparent box, the grip between the bottom rear edge of the cover and the relatively high wall of the second enclosure of the transparent box is lost and the cover can be closed with ease.

DETAILED DESCRIPTION OF THE PREFERRED EMBODIMENTS

Figure 1:
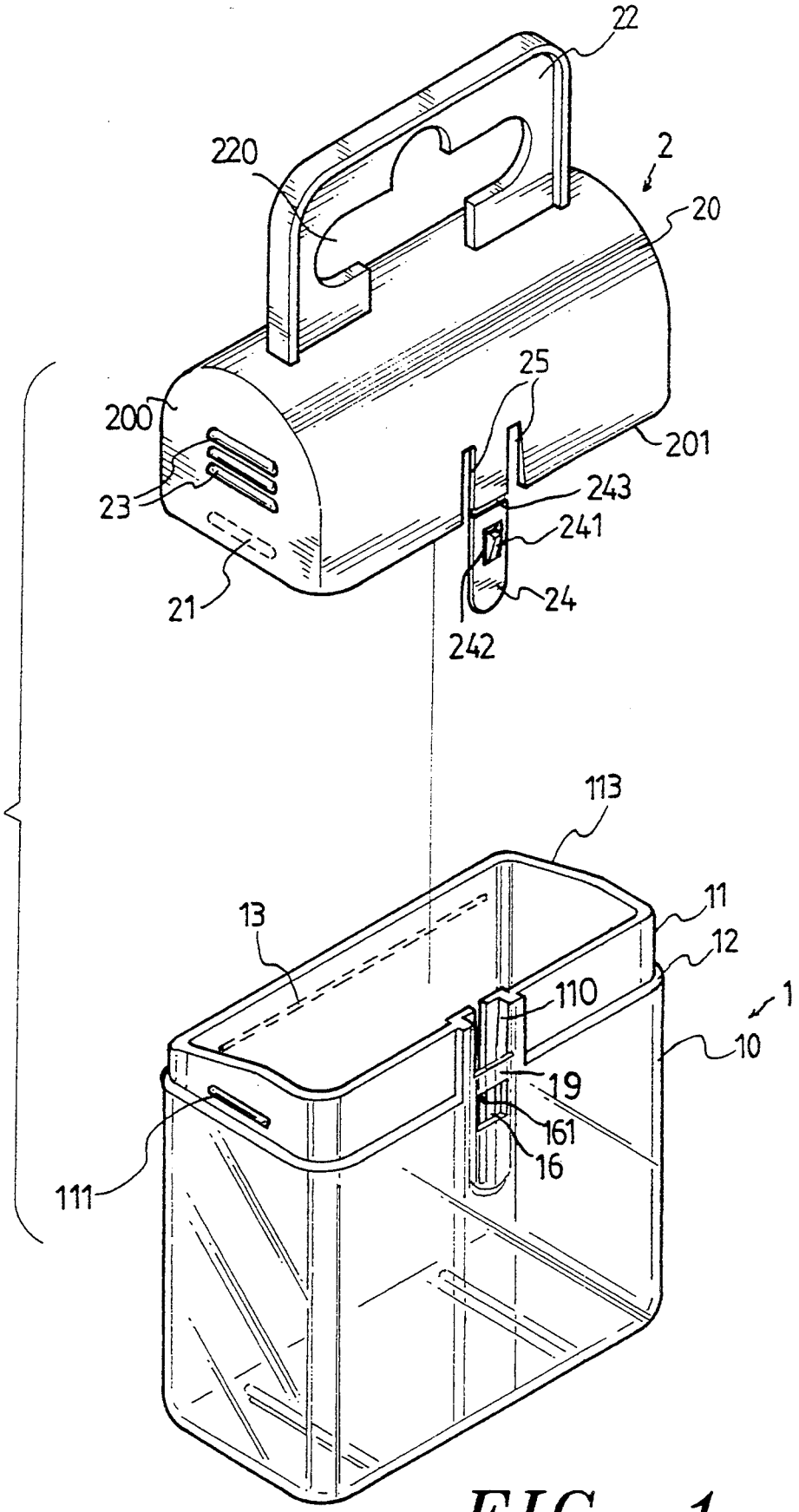
FIG. 1 illustrates an exploded view of a parts container in accordance with the present invention.

Referring to FIG. 1, a parts container in accordance with the present invention comprises a transparent box 1 and a cover 2 adapted to cover the transparent box 1. The transparent box 1 has a first enclosure 10 which has a front wall, a rear wall opposite to the front wall, and two side walls connected therebetween and a base, a second enclosure 11 integrally extending from a top portion of the first enclosure 10 thus defining a shoulder 12 therebetween. The second enclosure 11 has a relatively high wall, a relatively low wall, and two side walls connected therebetween, thus defining a slant opening 113 at a top of the transparent box 1. A vertical track 110 is defined from a top edge of the relatively high wall of the second enclosure 11 to substantially a middle position of the rear wall of the first enclosure 10, thus forming an inside wall and an outside wall around the vertical track 110. An aperture 16 is defined partway down the vertical track 110 on the outside wall of the rear wall of the first enclosure 10. An upper portion of the outside wall is cut out thus a bridge 19 is formed at the top of the aperture 16.

The cover 2 has two end walls 200 and an arcuate central wall 20 integrally connected therebetween. The arcuate central wall 20 has a rear edge and a front edge and the end walls 200 each have a side edge and the edges together define a lower periphery 201 of the cover 2. When the cover 2 is put on the transparent box 1, the lower periphery 201 thereof abuts against the shoulder 12 of the box 1. A flexible strip 24 extending downwardly from the rear edge of the arcuate central wall 20 of the cover 2 is received in the vertical track 110 of the transparent box 1. The cover 2 further has two slots 25 defined upwardly from the rear edge of the arcuate wall 20 along two sides of the flexible strip 24 thus extending a length of the flexible strip 24.

The flexible strip 24 has a flexible barb 241 pressed out thereof. The pressing out of the barb 241 results in a hole 242 larger than the flexible barb 241, whereby the flexible barb 241 can return into the hole 242 when it is temporarily deformed by a user's fingernail or the like. When the pressure of the fingernail is removed, the flexible barb 241 reverts to its projecting condition. When the flexible strip 24 is inserted into the track 110, the flexible barb 241 deflects inwards as the strip 24 proceeds down the track 110 and when the flexible barb 241 lines up with the aperture 16, the flexible barb 241 displaces outwardly engaging an upper lip 161 of the aperture 16, thus locating the strip 24, with the cover 2 secured to the transparent box 1.

Figure 2:
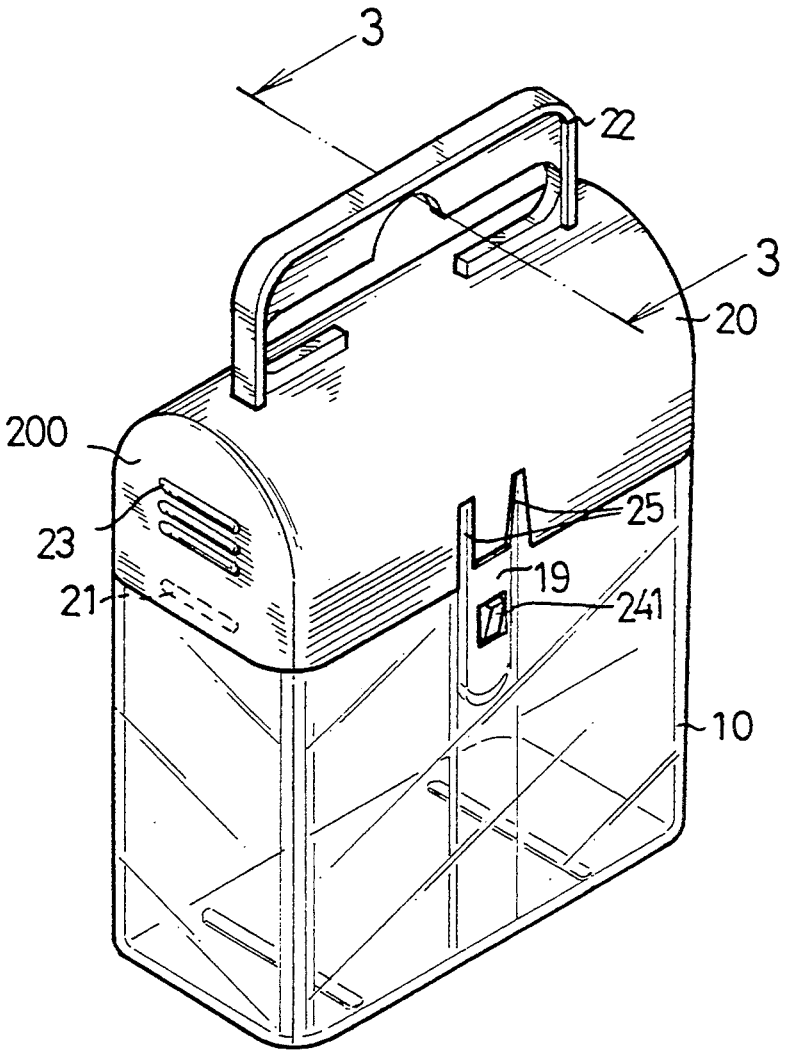
FIG. 2 is an assembled view of the parts container of FIG. 1.
Figure 3:
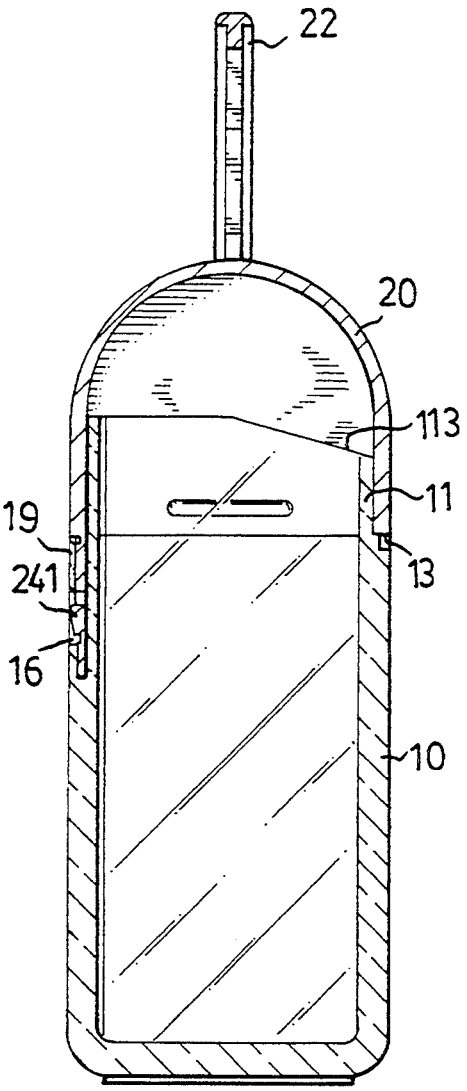
FIG. 3 is a cross-sectional view of FIG. 2.
Figure 4:
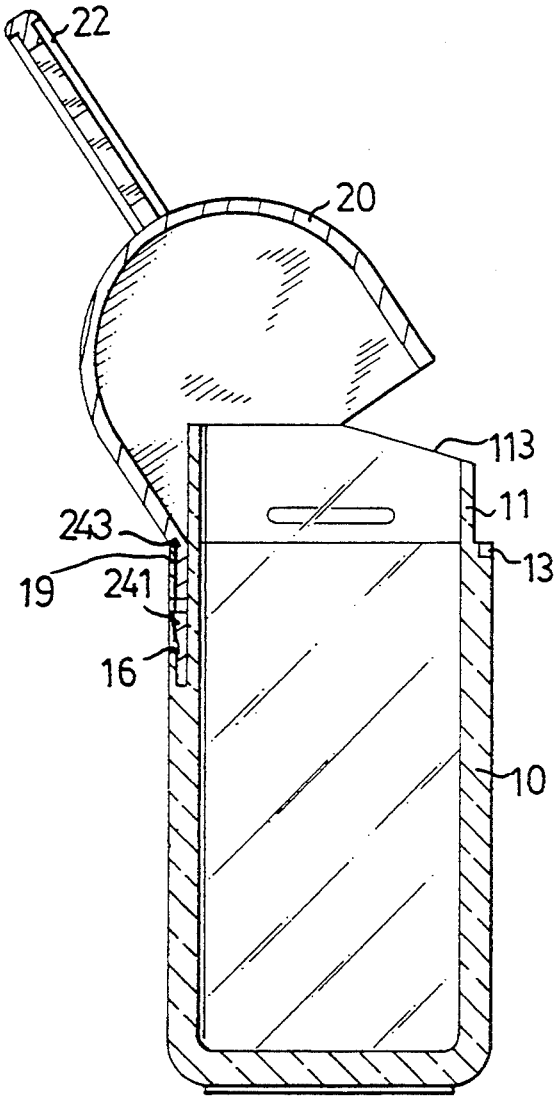
FIG. 4 is a similar view of FIG. 3, with a cover thereof being lifted up.

Normally, the parts container is in a "closed" status, i.e. the lower periphery 201 of the cover 2 is positioned against the shoulder 12 of the transparent box 1 and the flexible strip 24 of the cover 2 is inserted into the vertical track 110 of the transparent box 1 with the barb 241 thereof being engaged to the upper lip 161 of the hole 16 as shown in FIGS. 2 and 3. A groove 13 is formed in the shoulder 12 substantially at a top portion of the front wall of the first enclosure 10 allowing a user to push up the cover 2 therefrom by his/her fingernail. When a user wants to open the cover 2 to remove/insert parts from the box 1, he/she has one of his/her fingers depressed on the barb 241, and another finger pushes up the cover 2 to open the cover 2 as shown in FIG. 4. The flexible strip 24 has a groove 243 substantially defined in alignment with a lower periphery of the cover 2 functioning as a hinge point when the cover 2 is pushed open. As shown in FIG. 4, the flexible strip 24 provides a hinge action as the strip 24 is bent over the top of the bridge 19 that forms the top portion of the aperture 16. The cover 20 is held open by the user and parts are retrieved from the transparent box 10. When the user release his/her finger from the cover 2, elastic force in the strip 24 returns the cover 2 toward closed status and the user can close the cover with ease. Alternatively, the user can pull the cover vertically upwardly and lift the cover 2 up away from the transparent box 1 as shown in FIG. 1.

Figure 5:
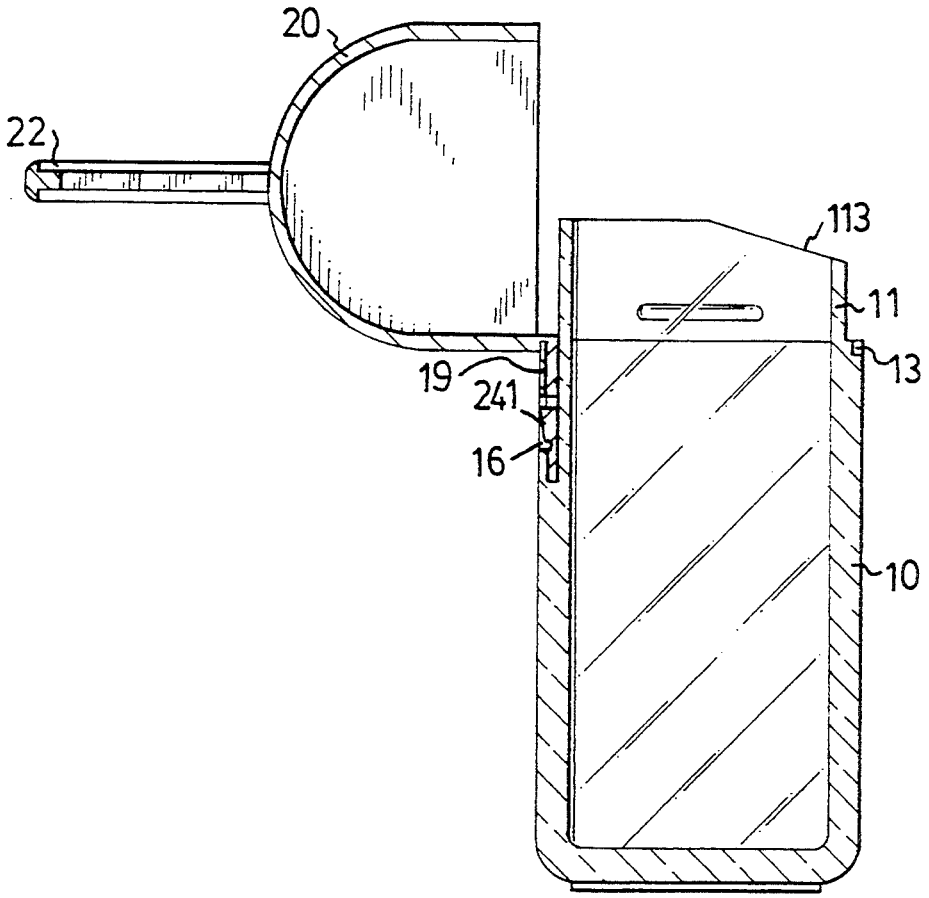
FIG. 5 illustrates the cover of the parts container of FIG. 4 has been fully opened.
Figure 6:
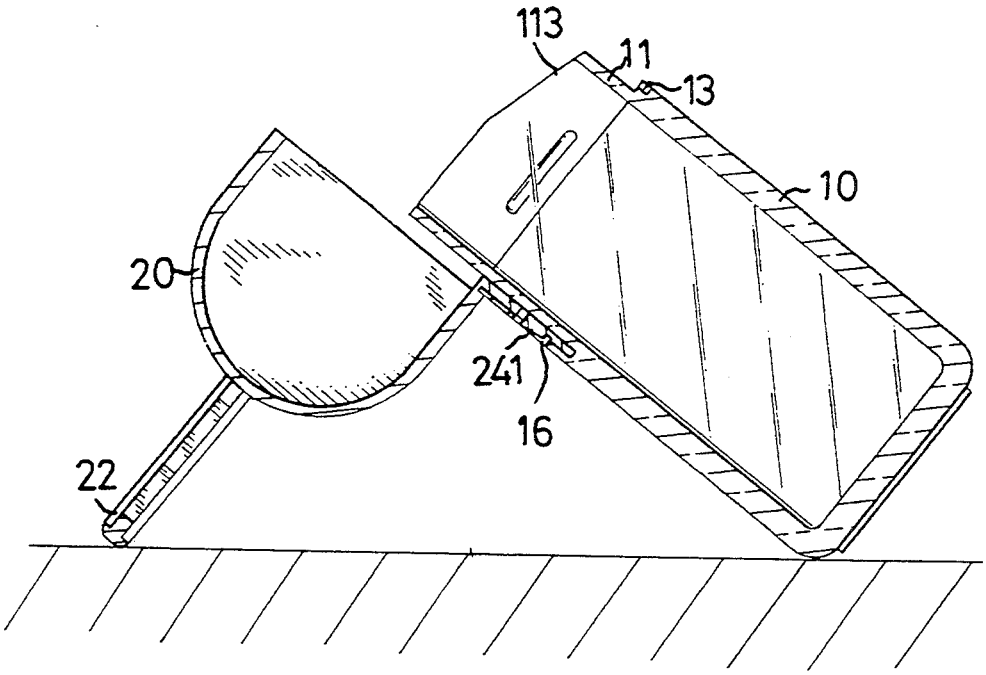
FIG. 6 illustrates the parts container of FIG. 5 is supported in an easel-fashion on a flat surface.

Referring to FIG. 5, alternatively the cover 20 is allowed to be opened fully so as to not obstruct decanting parts from the container. When the cover 2 is opened from the transparent box 1, a rear bottom edge of the cover 2 to the left and right of the strip 24 presses against the relatively high wall of the second enclosure 11 of the transparent box 1 bending the groove 243 at the strip 24 until when pivoted fully open, it remains in a fully open position, resisting closing. Therefore, the cover 2 is captive to the transparent box 1 and opened fully so as to not obstruct decanting parts from the container 1. Also, the box 1 with its fully-opened cover 2 now can be placed on a flat surface and is supported in an easel-fashion thus preventing parts from falling out of the container as shown in FIG. 6. In closing the cover after use, when a front bottom edge of the cover reaches the longitudinal center line of the transparent box, the grip between the bottom rear edge of the cover 2 and the relatively high wall of the second enclosure 11 of the transparent box 1 is lost and the cover 2 can be closed with ease.

Further referring to FIG. 1, the second enclosure 11 comprises two lugs 111 each at a side wall thereof and the cover 20 has two grooves 21 each at an inner periphery of the two side walls thereof for receiving the lugs 111 when the cover 2 is positioned around the first enclosure 11 of the transparent box 1. The cover 2 has a handle plate 22 protruding from a top thereof by which a user can lift the cover 2 up from the second enclosure 11 of the transparent box 1. The handle plate 22 has at least a hole 220 defined therein for easy handling by a user. The cover 2 comprises a plurality of lugs 23 at two side walls thereof by which a user can also push the cover 2 up from the transparent box 1.

Although the invention has been explained in relation to its preferred embodiment, it is to be understood that many other possible modifications and variations can be made without departing the spirit and scope of the invention as hereinafter claimed.

I claim:

1. A parts container comprising a transparent box having a first enclosure which has a front wall, a rear wall opposite to said front wall and two side walls connected therebetween, a second enclosure extending from a top portion of said first enclosure having a relatively high wall, a relatively low wall, and two side walls connected therebetween, thus defining a slant opening at a top thereof, a shoulder being defined between said first enclosure and said second enclosure, a vertical track being formed from a top periphery of said relatively high wall of said second enclosure to substantially a middle position of the rear wall of said first enclosure;

a cover adapted to cover said second enclosure of said box having a lower periphery thereof abutting against said shoulder comprising a flexible strip which extends downwardly from a wall of said cover and is received in said vertical track of said transparent box.

2. A parts container as claimed in claim 1 wherein said cover further has two slots defined along two sides of said flexible strip thus extending a length of said flexible strip.

3. A parts container as claimed in claim 1 wherein said flexible strip further comprises a groove substantially defined in alignment with a lower periphery of said cover functioning as a hinge point when said cover is pushed open.

4. A parts container as claimed in claim 2 wherein said transparent box has an aperture formed at the rear wall thereof and said flexible strip has a barb formed at substantially a middle portion thereof such that said barb engages to said aperture when said flexible strip is received in said vertical track of said transparent box.

5. A parts container as claimed in claim 1 wherein said second enclosure comprises two lugs at two side faces thereof and said cover has two grooves at two opposite inner walls thereof for receiving said lugs when said cover covers said first enclosure.

6. A parts container as claimed in claim 1 wherein said cover has a handle plate protruding from a top of said cover allowing a user to push said cover up from said second enclosure of said box.

7. A parts container as claimed in claim 1 wherein said handle plate has at least a hole defined therein for easy handling by a user.

8. A parts container as claimed in claim 1 wherein said cover comprises a plurality of lugs protruding from two opposite face thereof by which a user may push the cover up from the box.

* * * * *